United States Patent [19]

Pacca

[11] Patent Number: 4,850,141

[45] Date of Patent: Jul. 25, 1989

[54] AUTOMATIC EXPANDER WINDOW

[76] Inventor: Stephen R. Pacca, 150 Overlook Ave., Apt. 15F, Hackensack, N.J. 07601

[21] Appl. No.: 199,450

[22] Filed: May 31, 1988

[51] Int. Cl.[4] ..... E06B 3/32; E06B 1/04

[52] U.S. Cl. ..... 49/380; 49/505; 52/217

[58] Field of Search ..... 49/505, 380, DIG. 2; 52/217; 160/376, 372, 374

[56] References Cited

U.S. PATENT DOCUMENTS

| | | | |
|---|---|---|---|
| 3,583,114 | 6/1971 | Belfor | 49/505 X |
| 4,691,477 | 9/1987 | Governale | 49/380 |
| 4,702,051 | 10/1987 | Miller | 49/505 X |
| 4,742,647 | 5/1988 | Pacca | 49/505 |

*Primary Examiner*—Philip C. Kannan
*Attorney, Agent, or Firm*—Charles E. Baxley

[57] ABSTRACT

An automatic expander replacement window has a frame including left and right side member assemblies, a head member assembly and a sill member, each assembly including a frame element, an expansion element associated therewith and movable between a retracted position and an expanded position, a biasing element between and engaging the expansion element and its associated frame element and is of maximum bias where the expansion element is in its retracted position. A releasable strap holes the expansion element in the retracted position until the strap is cut, whereupon the biasing element drives the expansion element to its expanded position.

1 Claim, 3 Drawing Sheets

AUTOMATIC EXPANDER WINDOW

BACKGROUND OF THE INVENTION

This invention relates to window construction and more particularly to replacement window construction and still more particularly to an automatic expander window which facilitates installation.

Prior art replacement windows typically require the removal of the inside stop molding and trim for installation. It is known that this necessary removal causes many problems, such as broken moldings, chipped moldings and cracked paint. In addition, the time needed for molding removal is a significant part of the total installation time.

My prior U.S. Pat. No. 4,742,647 presents a substantially improved window that includes expansion elements, so that the window as manufactured can be substantially smaller than the prior replacement windows.

By virtue of the expansion elements of the allowed application, the width of the window can be expanded by about 0.5 inch (1.27 cm) on each side, for an overall width expansion of about 1 inch (2.54 cm), and the frame of the window can be made slightly but significantly narrower than is possible with prior art replacement windows, whereby the window can be placed in the opening therefor and the expanded to full size, thus avoiding the necessity for removing existing stop moldings or inside trim during installation and avoiding problems or broken moldings, chipped moldings and cracked paint, and also reducing installation time. However, the expansion elements require manual manipulation between retracted and expanded positions.

The present invention presents an improvement over the construction of the allowed application, in that the invention enables the expansion to take place automatically, thereby automatically saving substantial amounts of installation time and reducing cost to the contractor and also to the customer.

Another advantage of the present invention over that of the allowed application is that the present invention permits expansion on the order of about 1.125 inches (2.86 cm) on each side and on the top or head of the window, whereas the allowed application permits expansion on the order of only about 0.5 inch (1.27 cm) on each side and permits no expansion on the top or head of the window.

The inventive window has a frame and expansion elements that are movable relative to the frame between retracted positions and expanded positions and has biasing elements which urge the expansion elements toward their expanded positions. Releasable restraining means hold the expansion elements in their retracted positions until the window is positioned in the window opening, at which time the installer releases the restraining means and expansion of the window automatically takes place, caused by the biasing elements pushing the expansion elements to their expanded positions against the wall of the opening.

The frame and the expansion are of noncorrosive material, such as polyvinyl chloride (PVC).

The biasing elements are stainless steel springs, so all parts of the window are either PVC or stainless steel and the window is satisfactory for use in any climate whatsoever.

SUMMARY OF THE INVENTION

An automatic expander replacement window which is a preferred embodiment of the invention comprises a frame including left and right side member assemblies, a head member assembly and a sill member. Each assembly includes a frame element, an expansion element associated therewith and movable between a retracted position and an expanded position. A biasing element is between and engages each expansion element and its associated frame element and is of maximum bias when the expansion element is in its retracted position. A releasable strap holds the expansion element in its retracted position until the strap is cut, whereupon the biasing element automatically drives the expansion element to its expanded position.

DESCRIPTION OF THE INVENTION

Figure 1:
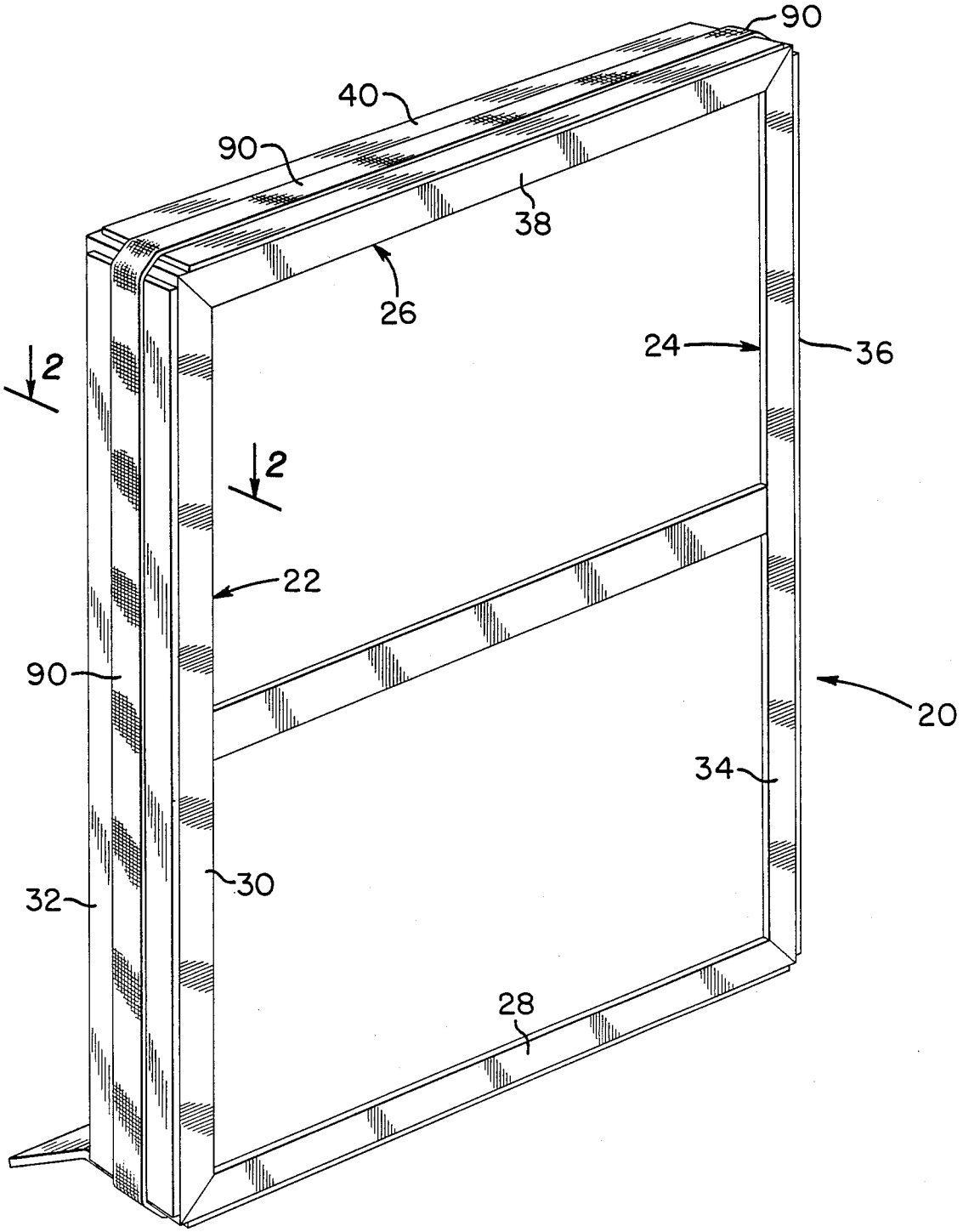
FIG. 1 is a somewhat schematic perspective view of an inventive automatic expander window, the expansion elements shown retracted.

FIG. 1 shows in perspective an automatic expander window including a frame 20 including left and right parallel side member assemblies 22 and 24, respectively, a head member assembly 26 joining the upper ends of assemblies 22 and 24, and a sill member 28 joining the lower ends of assemblies 22 and 24.

Left side member assembly 22 includes a left side frame element 30 and a left side expansion element 32. Right side member assembly 24 includes a right side frame element 34 and a right side expansion element 36. Head member assembly 26 includes a head member frame element 38 and a head member expansion element 40.

Left side frame element 30, right side frame element 34 and head member frame element 38 are formed of identical extrusions of noncorrosive plastic material, such, for example, as PVC.

Left side expansion element 32, right side element 36 and head member expansion element 40 are formed of identical extrusions of noncorrosive plastic material, such, for example, as PVC.

Sill member 28 is also formed of an extrusion of noncorrosive plastic material, such, for example, as PVC.

Because the extrusions of frame elements 30, 34 and 38 are the same, and because the extrusions of expansion elements 32, 36 and 40 are the same, only one of each needs to be described. Accordingly, elements 30 and 32 and the manner in which they are assembled will be described as exemplary. For this purpose, reference is at first made particularly to FIGS. 2 and 3. Frame element 30 has a floor 42 and sidewalls 44 and 46 perpendicular to floor 42 and parallel to each other and extending above and below floor 42. Sidewall 44 has an upper edge 45 and sidewall 46 an upper edge 47. Sidewalls 44 and 46 extend the same distance above floor 42 and the same distance below floor 42. The lower edge of sidewall 44 is determined by an outwardly extending flange 48 and the lower edge of sidewall 46 is determined by an outwardly extending flange 50. The outer edge of flange 48 is determined by an upwardly extending flange 52 which confronts and is spaced from sidewall 44 and is substantially coextensive therewith, having an upper free edge 54 flush with upper edge 45 of sidewall 44. The outer edge of flange 50 is determined by an upwardly extending flange 56 which confronts and is spaced from sidewall 46 and is substantially coextensive therewith, havng an upper free edge 58 flush with upper edge 45 of sidewall 56.

Adjacent its upper free edge 54, flange 52 has a downwardly facing barb 60, and adjacent its upper free edge 58, flange 56 has an downwardly facing barb 62.

Flanges 52 and 56 are resiliently flexible away from and toward sidewalls 44 and 46.

Figure 3:
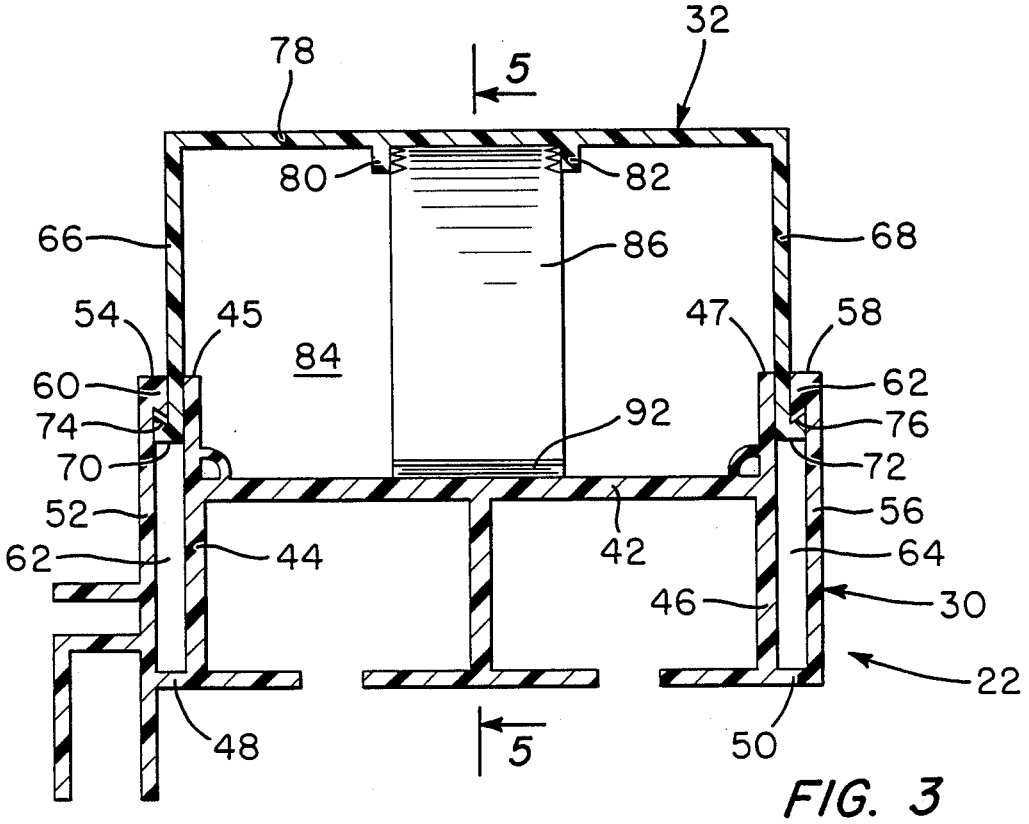
FIG. 3 is a view similar to FIG. 2 but showing the expansion element expanded.

It is evident that frame element 30 has similar longitudinal channels 63 and 64, best seen in FIG. 3. Channel 63 is provided by sideway 44, flange 48 and flange 52 and channel 64 is provided by sideway 46, flange 50 and flange 56.

Expansion element 32 is generally U-shaped, including like side flanges 66 and 68 having free edges 70 and 72, respectively. Adjacent free edges 70 and 72, element 32 has external, upwardly facing barbs 74 and 76, respectively.

The upper edges of flanges 66 and 68 are joined by a base element 78. Base element 78 is provided, on its internal surface with a pair of spaced ridges 80 and 82.

Expansion element 32 is assembled with frame element 30 by inserting flanges 66 and 68 into channels 63 and 64, respectively, and squeezing the parts together. This will spread flanges 52 and 56 to permit barbs 60 and 74 to pass each other into interengaging relationship, likewise barbs 62 and 76. This results in permanent assembly of these parts, and provides a chamber 84 of variable volume.

The expander window also includes three (3) biasing elements illustrated as stainless steel spring members 86. One spring member 86 is within chamber 84, one is within the chamber associated with frame element 34 and one is within the chamber associated with frame element 38.

Figure 2:
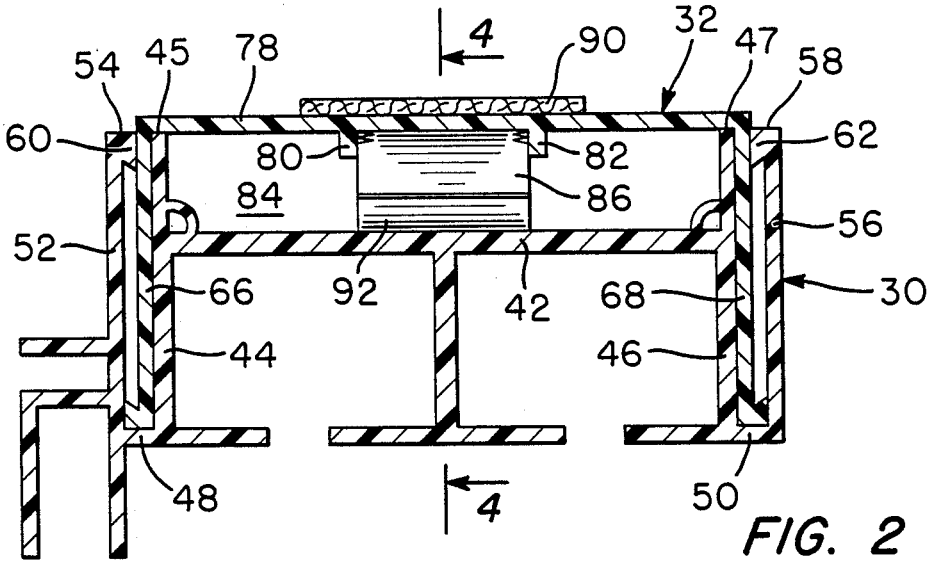
FIG. 2 is an enlarged view taken on line 2—2 of FIG. 1.
Figure 4:
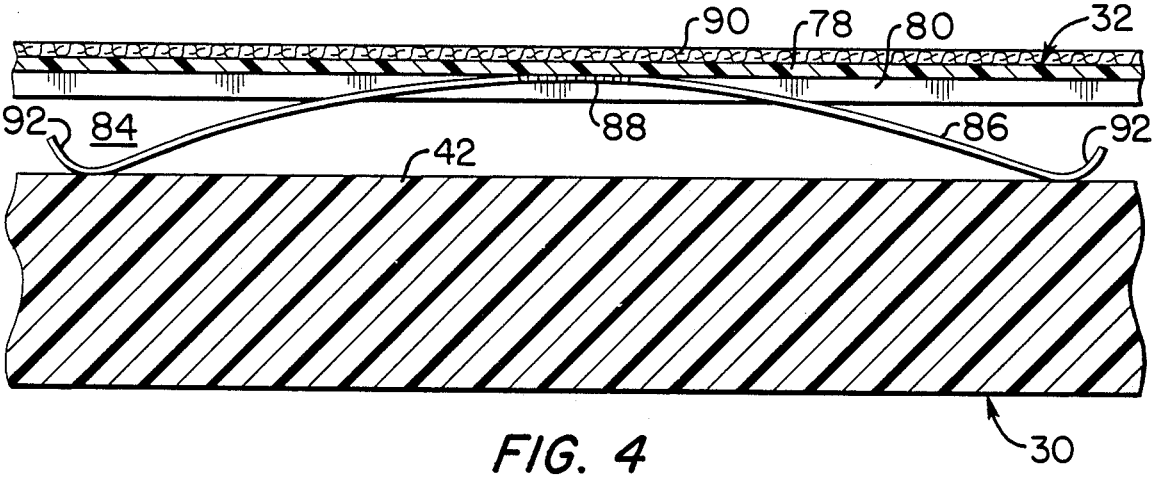
FIG. 4 is a fragmentary view taken on line 4—4 of FIG. 2.
Figure 5:
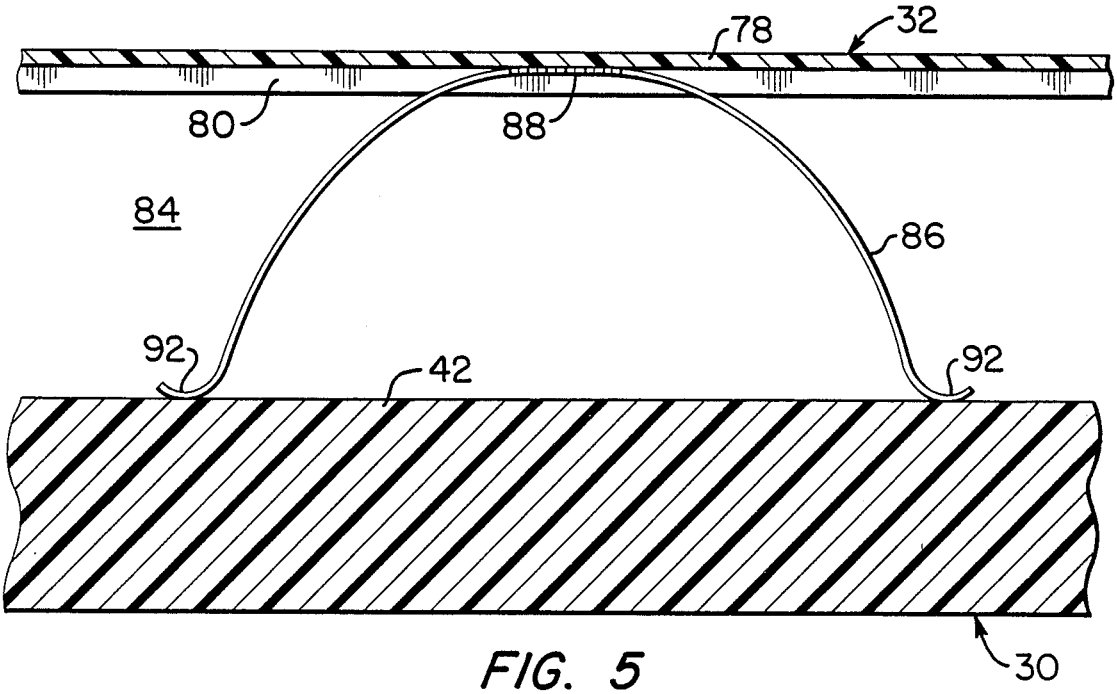
FIG. 5 is a fragmentary view on line 5—5 of FIG. 3.
Figure 6:
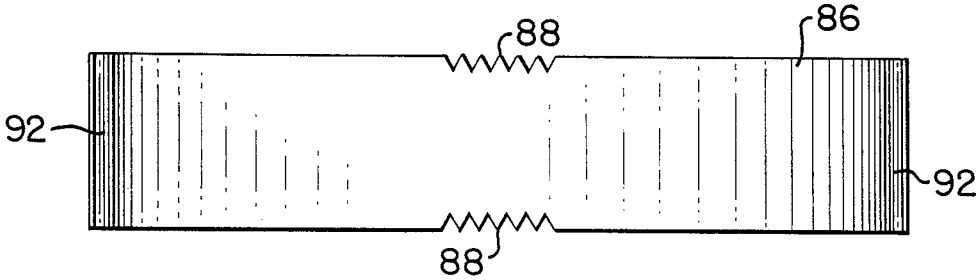
FIG. 6 is a top plan view of a biasing element in its unstressed condition.

Each spring member 86 is formed from a rectangular piece of stainless steel sheet provided with external teeth 88 centrally located along the sides. Member 86 is bowed upwardly in the middle in the position including teeth 88. Member 88 is also bowed upwardly at its ends, as indicated at 92. Member 86 is resiliently deformable between a maximum height in which it is relatively unstressed, as shown in FIGS. 3 and 5 and a minimum height in which it is relatively stressed, as shown in FIGS. 2 and 4. Spring member 86 is assembled with expansion element 32 (prior to assembly of the latter with frame element 30 as described above) by forcing teeth 88 into engagement with ridges 80 and 82.

Expansion element 32 is then entered into frame element 30 to the maximum possible extent, as shown in FIGS. 2 and 4, expansion element 36 is entered into frame element 34 to the maximum possible extent, and expansion element 40 is entered into frame element 38 to its maximum possible extent. Then, assembly of the automatic expander window is completed by wrapping Signode strapping material 90 around the window, to hold expansion elements 32, 36 and 40 in their retracted positions.

The window is placed in its opening, without removing the molding and the installer simply cuts strapping material 90, whereupon the biasing elements, i.e., spring members 86 automatically move their associated expansion elements outwardly to the position typified by FIGS. 3 and 5.

Exclusive of barbs 74 and 76, the width of expansion element 32 is about 2.978 inches (7.56 cm), and the height of side flanges 66 and 68 from base element 78 to free edges 70 and 72 is about 1.535 inches (3.90 cm). When expansion element 32 is in its expanded position as shown in FIG. 3, base element 78 of element 32 protrudes about 1.260 inch (3.20 cm) beyond the plane defined by upper edges 45 and 47 of sidewalls 44 and 46 and upper edges 54 and 58 of flanges 52 and 56, and free edges 70 and 72 are about 1.125 inches (2.86 cm) above flanges 48 and 50. When expansion element 32 is in its retracted position as shown in FIG. 2, free edges 70 and 72 are on flanges 48 and 50, respectively, and base element 78 is substantially on upper edges 45 and 47. Thus, between its retracted position and its expanded position, element 32 moves about 1.125 inches (2.86 cm), as stated hereinabove.

It is evident that the invention achieves the stated objects and advantages and others.

The disclosed details are exemplary only and are not to be taken as limitations on the invention except as those details are included in the appended claims.

I claim:

1. An automatic expander replacement window comprising a frame including left and right side member assemblies, a head member assembly and a sill member, each said assembly including a frame element, an expansion element associated therewith and movable between a retracted position and an expanded position, a biasing element between and engaging each said expansion element and its associated said frame element and of maximum bias where said expansion element is in said retracted position, and means for releasably holding said expansion element in said retracted position until released, said frame elements formed of identical extrusions of plastic material and said expansion elements are formed of identical extrusions of plastic material, said biasing element is a stainless steel spring, each said assembly including a chamber of variable volume between said frame element and said expansion element thereof and said spring being with said chamber and engaging said frame element and said expansion element in a direction tending to increase the volume of the chamber, wherein said means for releasably holding said expansion element in said retracted position comprises strapping material surrounding said frame.

* * * * *